US005813558A

United States Patent [19]

Burke

[11] Patent Number: 5,813,558

[45] Date of Patent: Sep. 29, 1998

[54] BABY SUPPLIES CASE AND BAG/BASSINET COMBINATION

[76] Inventor: Linda M. Burke, 361 Cherry Pl., East Meadow, N.Y. 11554

[21] Appl. No.: 877,432

[22] Filed: Jun. 17, 1997

Related U.S. Application Data

[60] Provisional application No. 60/020,410 Jun. 25, 1996.

[51] Int. Cl.[6] ..... B65D 69/00; A45C 9/00; A47C 17/82; A47D 7/00

[52] U.S. Cl. ..... 220/23.83; 5/93.1; 5/655; 150/112; 150/113; 190/1; 190/2; 190/109; 190/110; 206/233; 206/581; 206/823; 220/331; 220/334; 312/209; 312/286; 312/328

[58] Field of Search ..... 5/93.1, 94, 655; 150/106, 111, 112, 113; 190/1, 2, 102, 107, 108, 109, 110, 901; 108/11, 14; 312/3, 209, 310, 328, 286; 206/225, 233, 494, 581, 823; 211/71, 72, 74; 220/331, 334, 23.83, 23.86, 554; 215/322; 224/231, 577, 629

[56] References Cited

U.S. PATENT DOCUMENTS

| | | | |
|---|---|---|---|
| 185,372 | 12/1876 | Watts . | |
| D. 219,058 | 10/1970 | Kaczur | 211/74 X |
| 300,830 | 6/1884 | Arnold | 220/23.83 X |
| 448,554 | 3/1891 | Snaman, Jr. . | |
| 601,568 | 3/1898 | Jacoby | 312/310 X |
| 1,860,224 | 5/1932 | Bode | 312/328 X |
| 1,959,675 | 5/1934 | Hogg | 150/106 X |
| 1,972,027 | 4/1934 | Mote . | |
| 2,118,323 | 5/1938 | Murphy | 190/110 X |
| 2,305,279 | 12/1942 | Smith | 312/3 |
| 2,502,486 | 4/1950 | Savrin . | |
| 2,517,757 | 8/1950 | Adlerstein | 312/3 |
| 2,518,604 | 8/1950 | Douglas . | |
| 2,874,813 | 2/1959 | Bunte | 190/109 |
| 2,911,024 | 11/1959 | Miceli . | |
| 3,760,943 | 9/1973 | Reader | 312/3 X |
| 4,198,718 | 4/1980 | Ballard | 5/93 B |
| 4,210,186 | 7/1980 | Belenson | 150/52 J |
| 4,287,985 | 9/1981 | Feninger | 206/233 X |
| 4,335,812 | 6/1982 | Koves | 150/113 X |

(List continued on next page.)

OTHER PUBLICATIONS

Advertisement #1 in Natural Baby Exclusive Catalog, p. 65.
Advertisement #2 in Natural Baby Exclusive Catalog, p. 66.
Advertisement #1 in The Right Start Early Spring 1996 Catalog p. 12.
Abvertisement #2 in The Right Start Early Spring 1996 Catalog p. 27.
"Self–Adhering Nylon Tapes", Maurice Gershman, M.D. Journal of A.M.A., vol. 168, No. 7, Oct. 1958.

*Primary Examiner*—Kenneth J. Dorner
*Assistant Examiner*—Robert G. Santos
*Attorney, Agent, or Firm*—Michael D. Fitzpatrick

[57] ABSTRACT

A baby supplies case and bag/bassinet combination with an openable front flap. Unzipping the flap reveals a shelved case holding diapers and baby supplies. Attached to the lowest shelf by a hinge is a hollow wedge shaped baby wipes container of sufficient length to extend to a cutout in the above shelf where the wide end of the wedge-shaped container rests. The wide end has raised ridges at either end thereof which retain a protective lid in position. In the middle of the wide end is an oval opening which provides access to baby wipes. When this wedge shaped container is rotated downward and the protective lid is slid open, a baby wipe can be retrieved. Due to the wedge shape of the container, it will not impede the removal of objects from the shelf behind. Resting on the middle shelf of the case is a holder for a container of baby powder. When this holder is rotated downwardly, it hangs from supports attached to the shelf on which it was resting. This holder has openings in its side so that one can reach through the openings with one's hand positioned under the holder, and squeeze the powder container, thus dispensing powder into one's one hand while one restrains the baby with the other hand. When the shelved case is removed from the baby bag, the baby bag can be converted into a bassinet. A wall unit of the above is also described.

14 Claims, 12 Drawing Sheets

U.S. PATENT DOCUMENTS

| | | | |
|---|---|---|---|
| 4,482,522 | 11/1984 | Baudisch et al. | 211/74 X |
| 4,698,862 | 10/1987 | Mairs | 5/98 R |
| 4,739,809 | 4/1988 | Adams | 150/112 |
| 4,781,277 | 11/1988 | Lim | 5/655 X |
| 4,999,863 | 3/1991 | Kane | 5/98.1 |
| 5,036,989 | 8/1991 | Carilli | 211/74 |
| 5,038,426 | 8/1991 | Boretski | 5/93.1 |
| 5,042,664 | 8/1991 | Shyr et al. | 206/579 |
| 5,228,547 | 7/1993 | Yoo | 190/103 |
| 5,230,450 | 7/1993 | Mahvi et al. | 224/153 |
| 5,431,265 | 7/1995 | Yoo | 190/103 |

BABY SUPPLIES CASE AND BAG/BASSINET COMBINATION

1.0 RELATED APPLICATIONS

This application claims the benefit of U.S. Provisional Application No. 60/020,410 filed on Jun. 25, 1996.

2.0 BACKGROUND

While changing a baby, the baby's mother or nurse finds that at various times during the process, she needs three hands to change the baby. One instance is when applying baby powder—in this case she finds that she needs one hand to restrain the baby, one hand to hold a container of baby powder, and one hand into which to sprinkle the baby powder. And many times when she is in a hurry, especially when she is away from home, she needs a baby bag, in which everything is conveniently arranged, to quickly and conveniently change the baby.

In the past, various devices have been devised to assist a mother or nurse in changing a baby.

However, none of these devices conveniently assist the mother or nurse in changing a baby whilst using only one's two hands to do so.

It has long been a problem to quickly obtain needed supplies from a conventional baby bag in order to change a baby. With conventional baby bags, one has to dig around in the bag to find a diaper, the baby powder, and baby wipes. There is needed a portable baby bag which organizes these items so that they may be obtained conveniently for the purposes of changing a baby. It is especially desired that these items be so configured, that it be easy to restrain the baby with one hand while applying baby powder with the other.

For the foregoing reasons, there is a need for an attractive economical device which can assist one in quickly and conveniently changing a baby.

3.0 SUMMARY

3.1 Opening

Thus by means of my invention, there has been provided a baby supplies case and bag/bassinet combination which assists one in quickly and conveniently changing a baby.

3.2 Contents

Basically the present invention comprises a baby supplies case and a baby bag/bassinet combination.

In one embodiment, the baby supplies case consists of a holder for diapers with conveniently positioned containers for dispensing baby wipes and baby powder. After the baby supplies case is removed, the bag can be conveniently converted into a bassinet.

A lesser preferred embodiment is a wall unit which functions as a baby changing station.

The above features are objects of this invention. Yet further objects are as follows:

One of the primary objects of the present invention is to provide a baby supplies case and bag/bassinet combination for conveniently carrying about the various supplies needed for changing a baby.

Another object is to provide a baby supplies case in which containers for baby wipes and baby powder are so arranged as to maximize the speed and ease with which the baby can be changed.

An additional object is to provide a baby supplies case and bag/bassinet combination which can easily be opened up into a bassinet.

Yet another object is to provide a baby supplies case and bag/bassinet combination in which the containers for baby wipes and baby powder are so shaped and disposed within the case so as to provide minimum interference with retrieving the baby's diapers and other supplies.

A further object is to provide a baby supplies case and bag/bassinet combination that is simple and easy to use.

A still further object is to provide a baby supplies case and bag/bassinet combination that is economical in cost to manufacture.

Yet another object is to provide a baby supplies case and bag/bassinet combination in which the protective cover of the baby wipes container cannot come loose or slide away from the opening of the baby wipes container.

These and other objects, features, aspects, and advantages of the present invention will become better understood with regard to the following description, appended claims, and accompanying drawings and will be otherwise apparent to those skilled in the art.

For the purpose of illustration of this invention, a preferred embodiment and several nonpreferred embodiments are shown in the accompanying drawings. It is to be understood that this is for the purpose of example only and that the invention is not limited thereto.

4.0 BRIEF DESCRIPTION OF THE DRAWINGS

5.0 DESCRIPTION

5.1 Overview

The preferred embodiment of the present invention consists of a baby bag with an openable front flap. When the front flap is unzipped, a shelved case for holding diapers and baby supplies is revealed. Due to the case having shelves, all the baby supplies can be very nicely organized. No longer is there the nuisance of rummaging around in a prior art bag looking for a needed item. Attached to the lowest shelf by a hinge is the hinge connection end of a hollow wedge-shaped baby wipes container of sufficient length to extend to a cutout in the shelf above where the wide end of the wedge-shaped container rests. The wide end of the container has raised ridges at either end thereof which retain a protective lid in position. In the middle of the wide end is an oval opening (covered by the protective lid) which provides access to the baby wipes contained therein. When this wedge-shaped container is rotated outward and downward and the protective lid is slid open, the oval opening is revealed from which a baby wipe can be retrieved. Due to the sloping wedge shape of the container, objects (such as diapers) being removed from the shelf behind will not catch or get caught on it. Resting on the middle shelf of the case is a holder for a container of baby powder or cream. When this holder is rotated outwardly and downwardly, it hangs freely from supports attached to the shelf on which it was resting. This holder has openings in the sides thereof so that one can reach through the openings with one's hand positioned under the holder, and squeeze the tube of powder or cream contained therein, thus dispensing powder or cream into one's one hand while one restrains the baby with one's other hand. When the shelved case is removed from the baby bag, the baby bag can easily be converted into a bassinet.

5.2 DETAILED DESCRIPTION OF THE ELEMENTS

Figure 1:
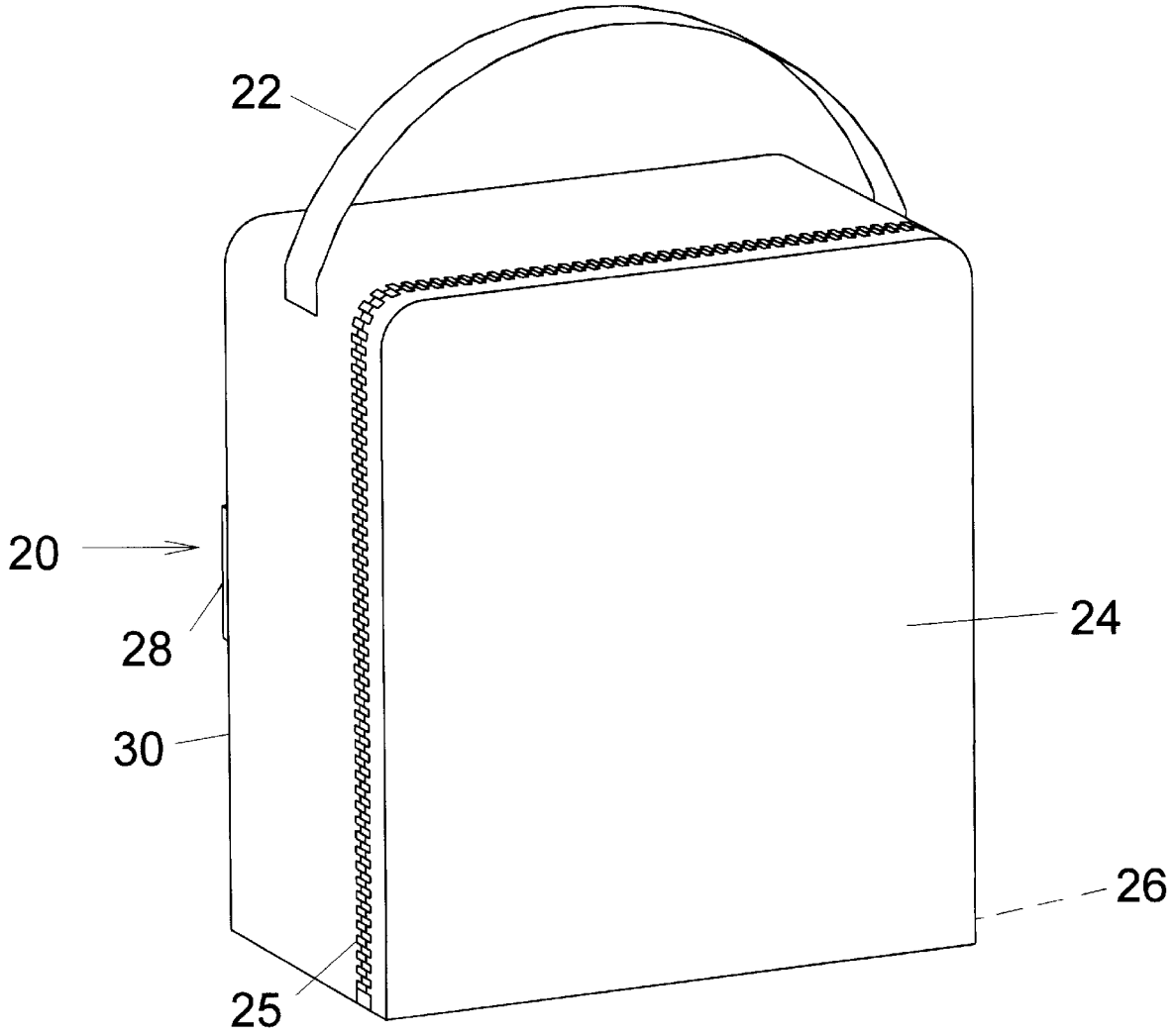
FIG. 1 shows a front perspective view of the preferred embodiment closed and ready to carry.
Figure 2:
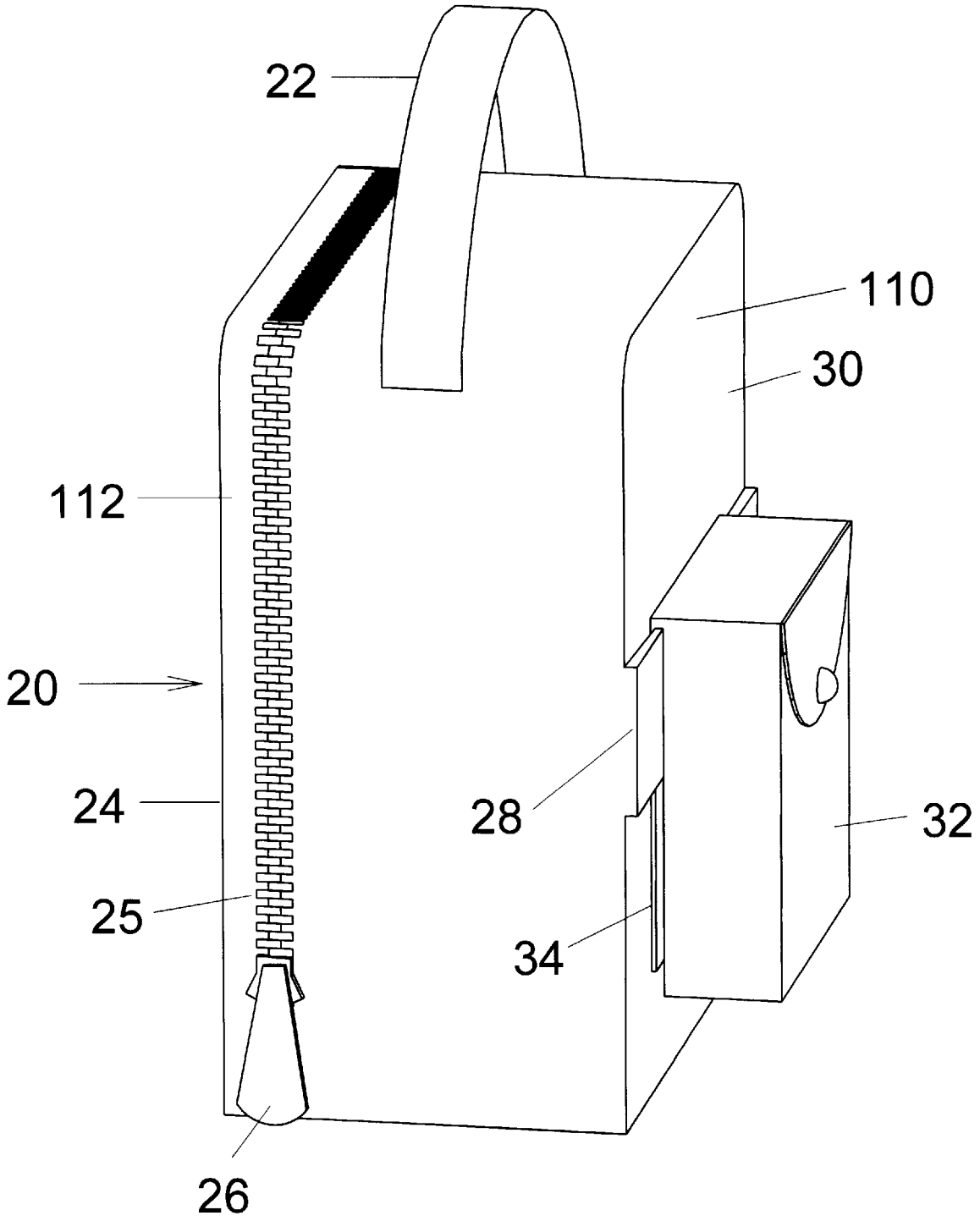
FIG. 2 shows a side perspective view of the preferred embodiment closed and ready to carry.
Figure 3:
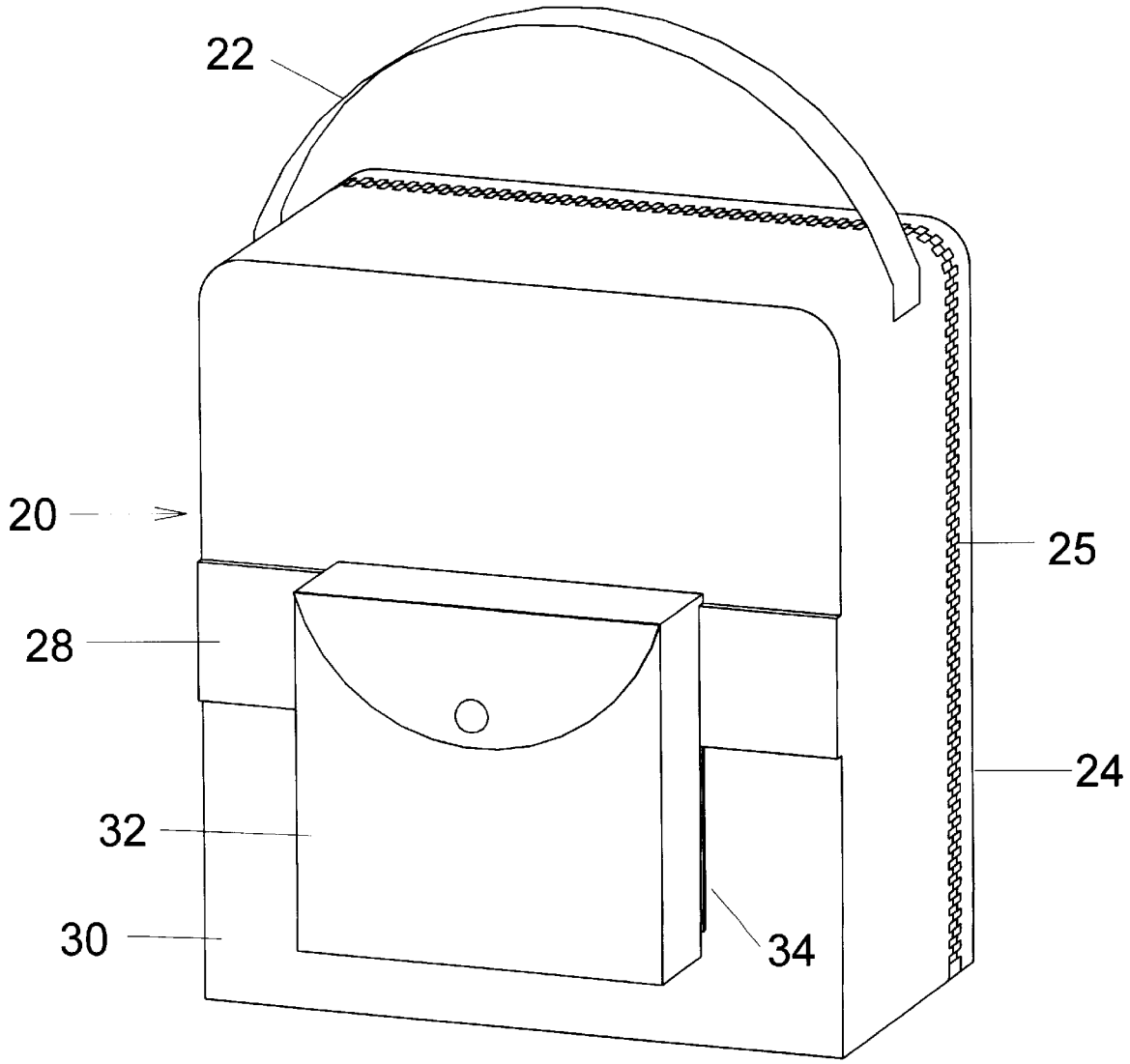
FIG. 3 shows a rear perspective view of the preferred embodiment closed and ready to carry.

Turning now descriptively to the drawings, in which similar reference characters denote similar elements throughout the several views, FIG. 1 illustrates the front perspective view of a baby supplies case and bag/bassinet combination, generally shown as 20. Attached to the top of the baby bag is a strap 22 by which it may be carried. Alternatively a grip or a plastic or metal handle may be attached to the top of the baby bag to provide means for carrying the baby bag. FIG. 1 also shows an openable flap 24 which can be unzipped by means of zipper handle 26 (best seen in FIG. 2) to reveal the contents of the baby bag 20. FIGS. 2 and 3 show side and rear perspective views respectively of the baby bag 20. As seen in these two views, there is a flexible strap 28 attached to the rear 30 of the bag 20. A pouch 32 with a lip 34 of suitable size for removably sliding the lip 34 between the strap 28 and the rear 30 of the bag 20, is shown with its lip 34 having been inserted between the strap 28 and the rear 30 of the bag 20. This pouch 32 may be used to hold baby bottles. It is attached to the rear 30 of the bag 20 instead of to the front flap 24, because if it were affixed to the front flap 24, it would prevent the front flap 24 from lying down flat after it was unzipped and pulled downward.

Figure 4:
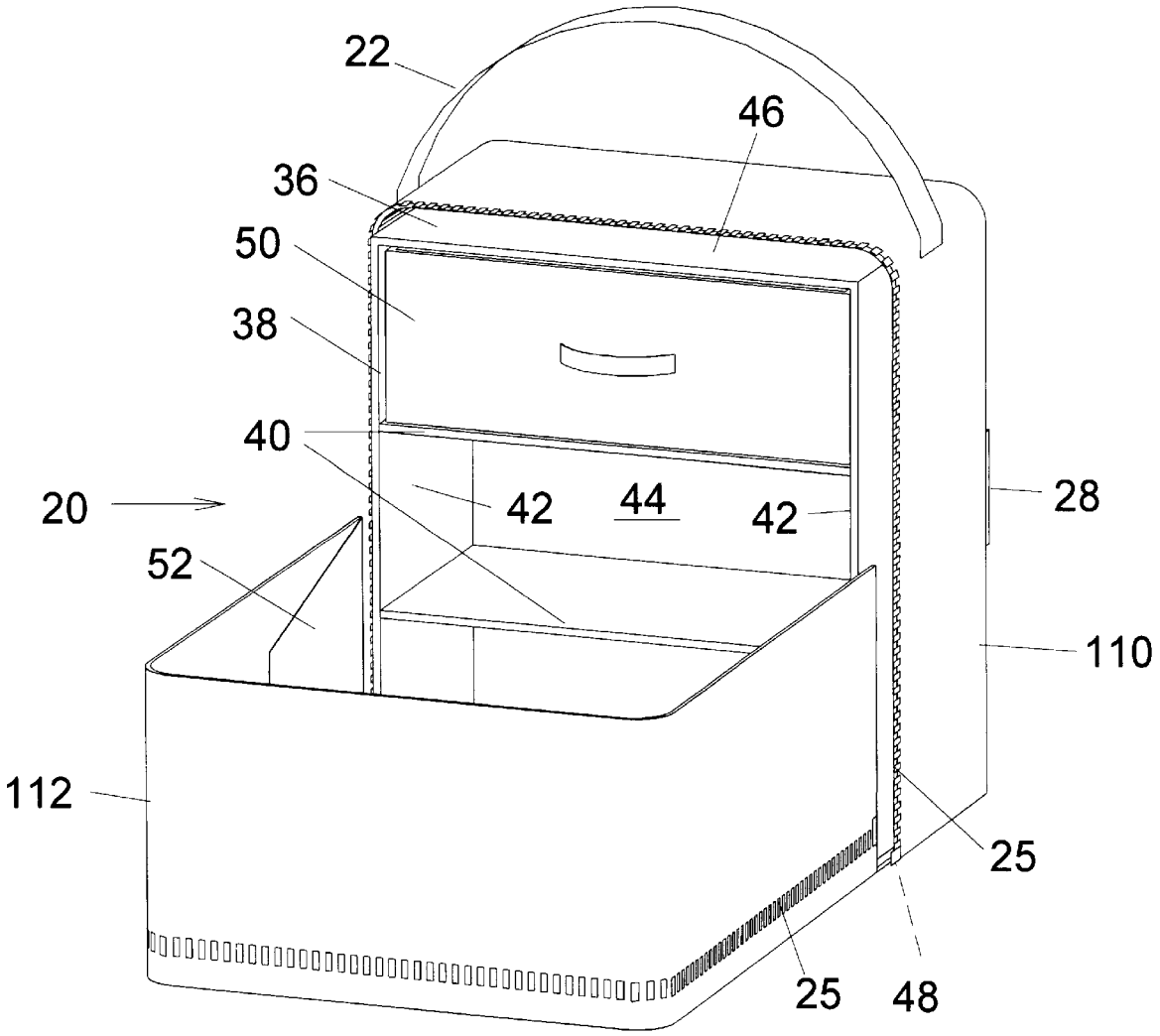
FIG. 4 shows a front perspective view of the preferred embodiment of the baby bag/bassinet combination, opened to show a nonpreferred version of the baby supplies case within.
Figure 5:
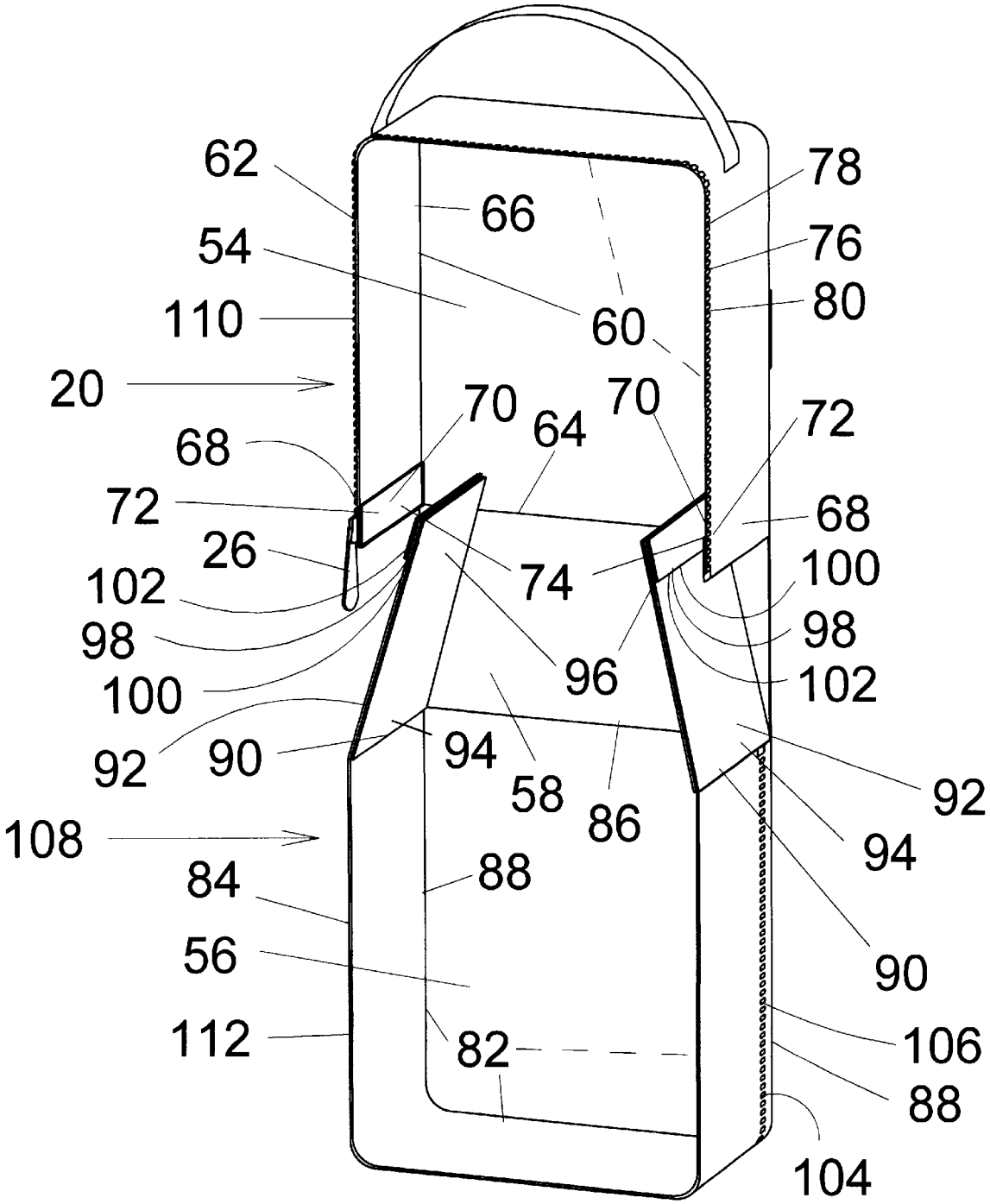
FIG. 5 shows the preferred embodiment of the baby bag/bassinet combination fully opened, the case removed, and the flaps about to be attached to the sides to form a bassinet for a baby.
Figure 7:
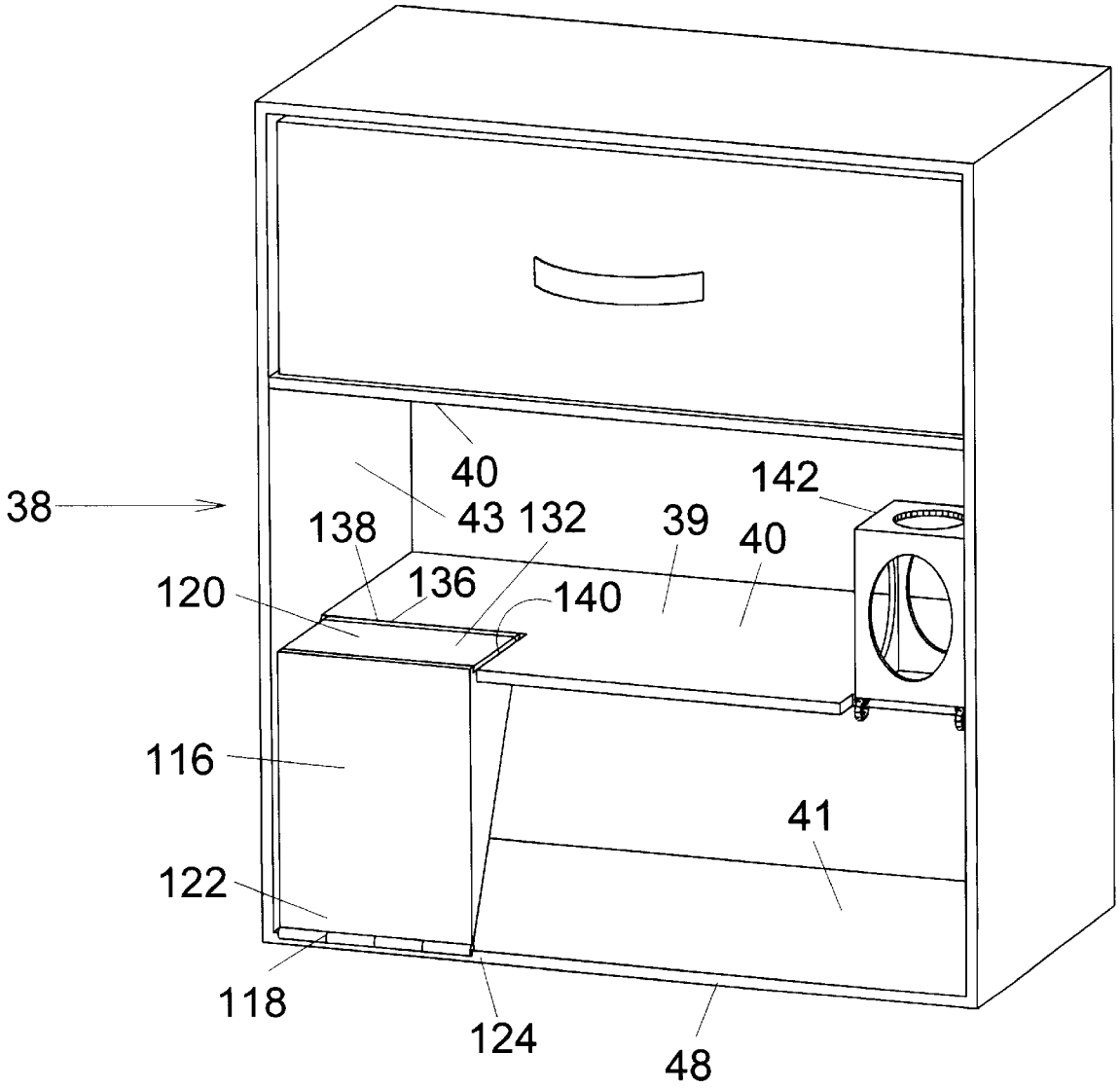
FIG. 7 shows a front perspective view of the preferred version of the baby supplies case with the baby wipes container and the baby powder holder moved to their storage positions.
Figure 8:
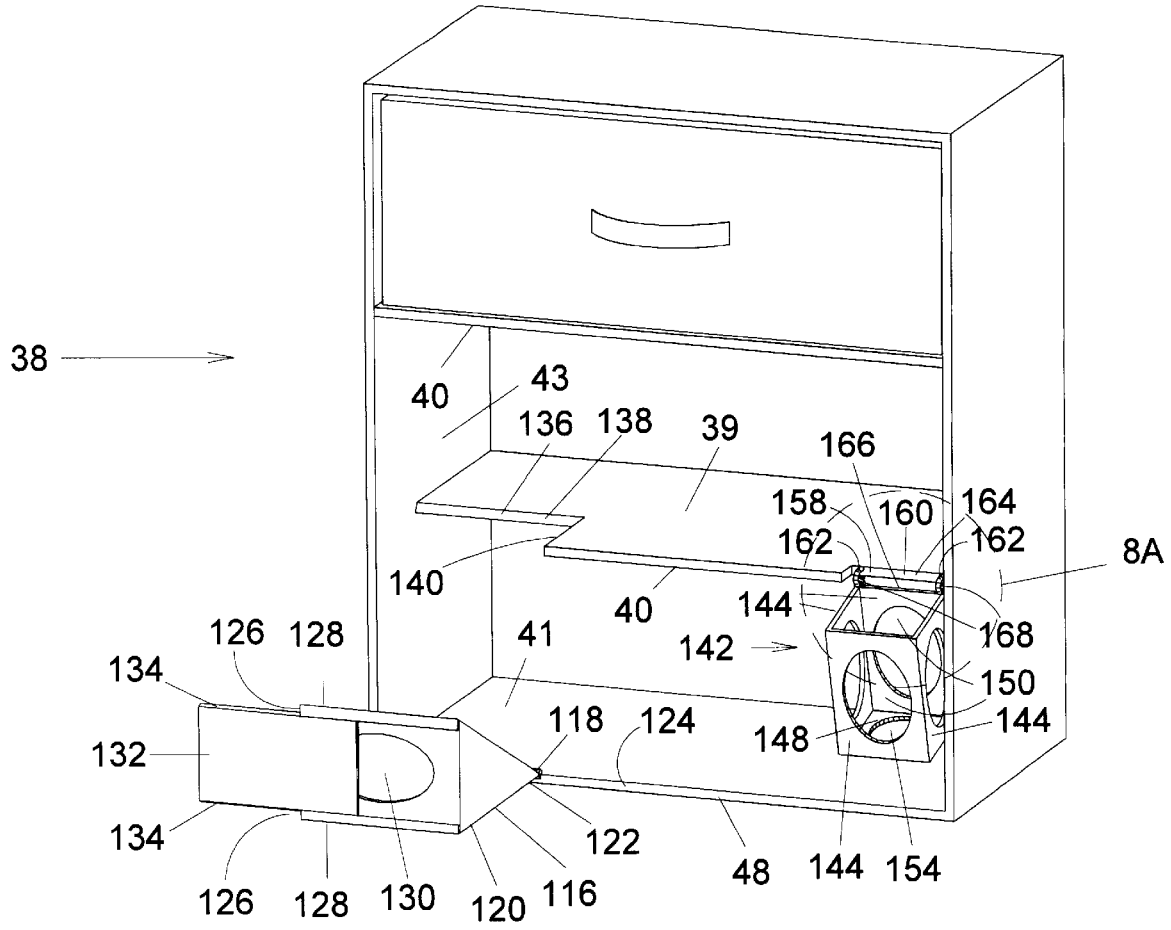
FIG. 8 shows a front perspective view of the preferred version of the baby supplies case with the baby wipes container and the baby powder holder moved to their operational positions.
Figure 9:
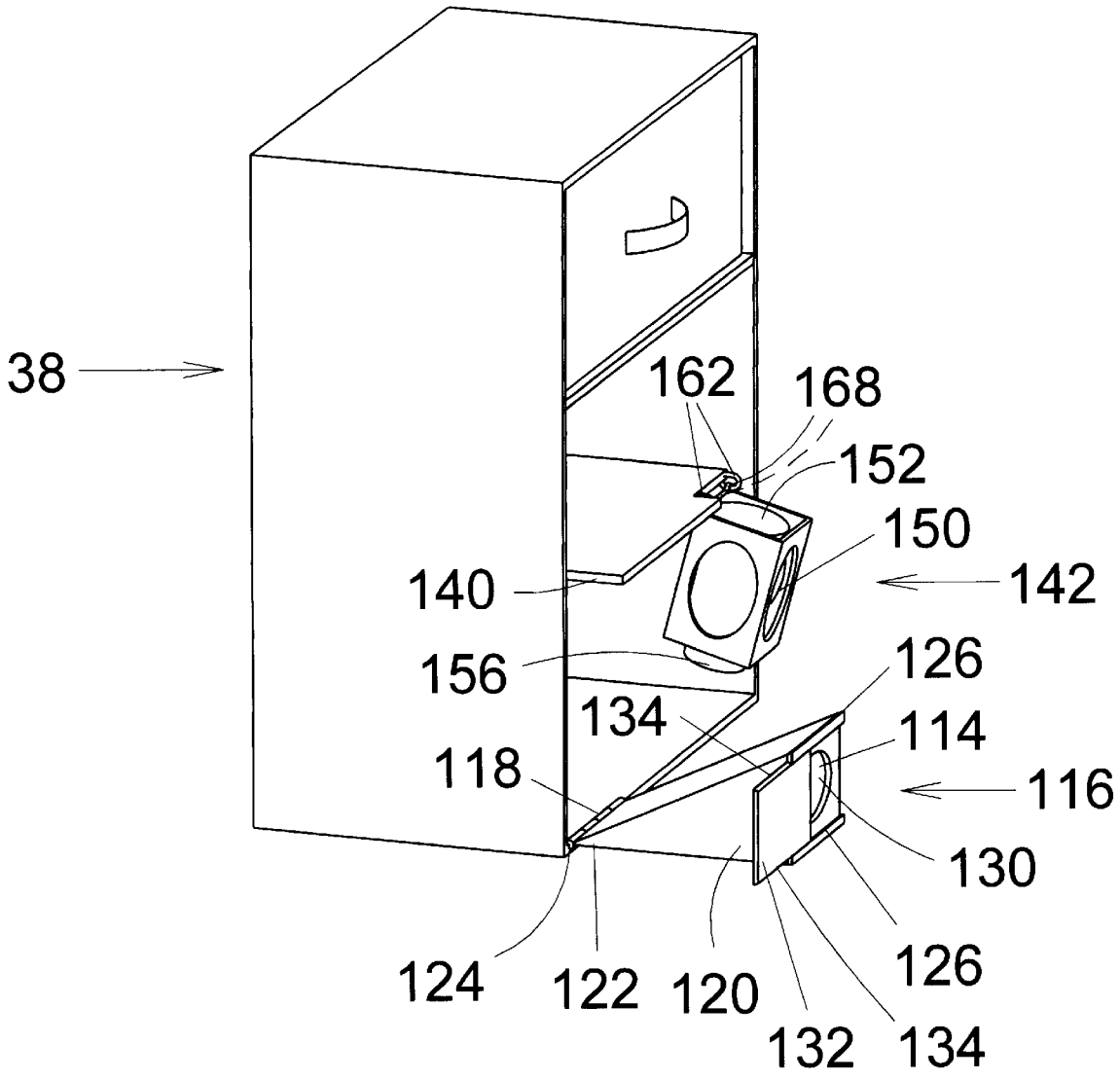
FIG. 9 shows a side perspective view of the preferred version of the baby supplies case with the baby wipes container and the baby powder folder in their operational positions.

When the zipper 25 is unzipped (via zipper handle 26) and the front flap 24 is opened, there is revealed a compartment 36 such as a case, generally shown as 38 in FIGS. 7, 8, and 9, with several shelves 40, 41 for holding baby diapers and other baby supplies. As illustrated in FIG. 4, the case 38 is a box-like structure with two vertical side walls 42, 42, a back wall 44, an upper horizontal wall 46, and a horizontal bottom wall 48. The case 38 is open at the front thus making the shelves 40, 40, 41 thereof easily accessible. In this embodiment, there are three shelves 40, 40, and 41. On the top shelf is a drawer 50 for holding those supplies which might tend to roll around. Also appearing is one of the two flaps 52 which can be used to convert the baby bag 20 into a bassinet once the shelved case 38 has been removed. FIG. 5 shows the baby bag 20 with the shelved case 38 removed. As can be seen in this figure, the baby bag 20 consists of two approximately rectangular pieces of material 54, 56 and an intermediate piece of joining material 58. As shown, the first rectangular piece of material 54 has three edges 60 with a perpendicular side wall 62 running the length of these three edges 60. (The first rectangular piece of material along with the perpendicular side wall is collectively referred to as the first section 110 of the bag.) The fourth edge 64 is open having no wall. The wall which runs the length of the three edges has a lower edge 66 by which it is fixedly attached to the three edges 60, 60, 60 of the first piece of material 54. The two ends 68, 68 of the wall 62 have fastening material 70 such as mating pieces of hook and loop fastener material 72 affixed to their inner surfaces 74, 74. The wall 62 has means for fastening 76 such as a mating zipper half-section 78 attached to its upper edge 80.

The second piece of material 56 likewise has three edges 82, 82, 82 with a perpendicular side wall 84 running the length of these three edges 82, 82, 82. The fourth edge 86 is open having no wall. This wall 84 has a lower edge 88 by which it is fixedly attached to the three edges 82, 82, 82 of the second piece of material 56. The first and second ends 90, 90 of the wall 84 have flaps 92, 92 hingedly or hingeably attached to them. Each of the flaps 92, 92 has a first end 94 hingedly attached to the end of the wall 90 to which it is so attached and a second end 96 having fastening material 98 such as a mating piece of hook and loop fastener material 100 affixed to the outer surface 102 thereof. The wall 84 has means for fastening 104 such as mating zipper half-section 106 attached near its lower edge 86. (The second rectangular piece of material along with the perpendicular side wall and the flaps is collectively referred to as the second section 112 of the bag.)

An intermediate piece of material 58 joins the first and second pieces 54, 56 of material at their edges 64, 86.

Figure 6:
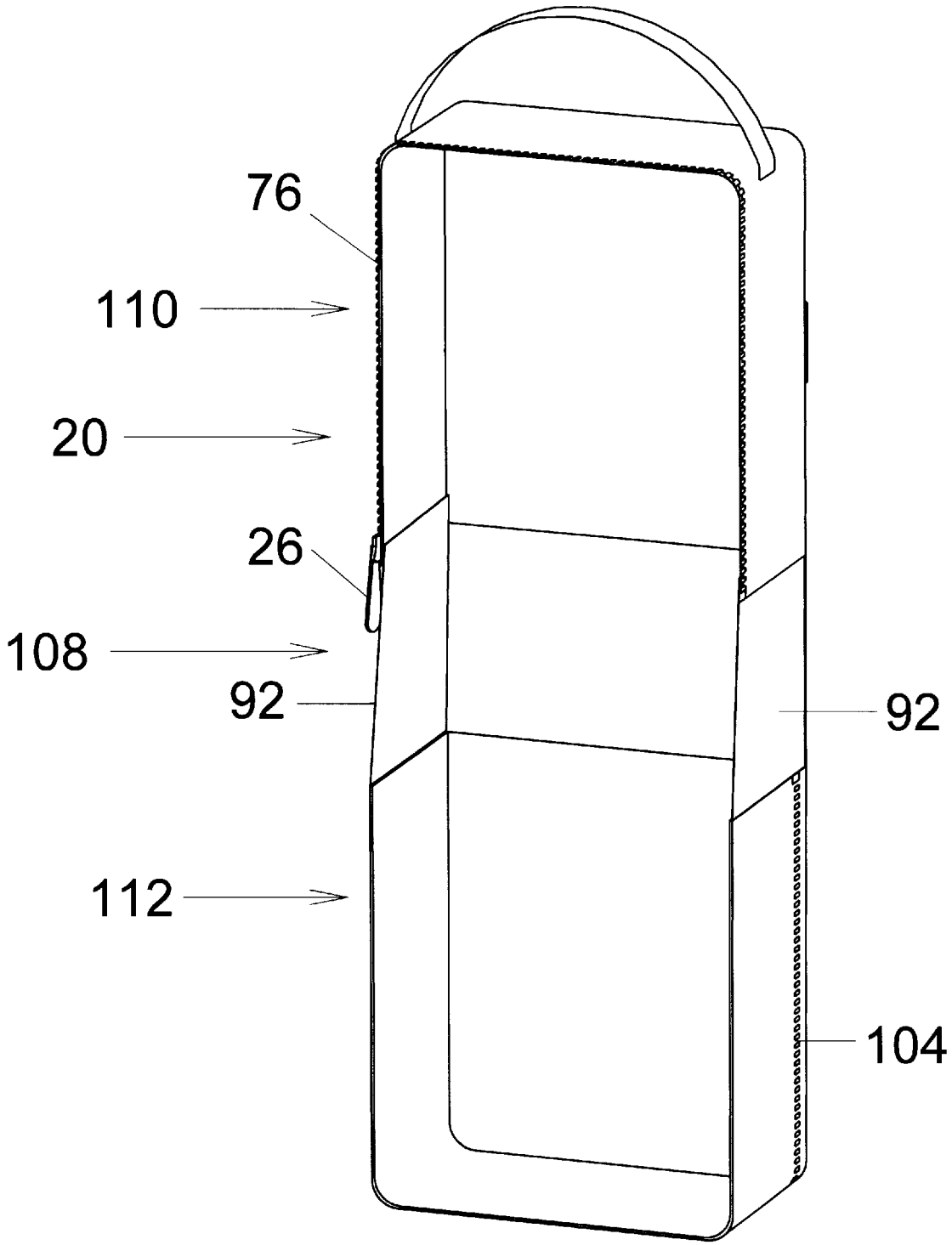
FIG. 6 shows the preferred embodiment of the baby bag/bassinet combination fully opened, the baby supplies case removed, and the flaps attached to the sides thus forming a bassinet for a baby.

Thus when the bag 20 is in its open position and the case 38 is removed, the bag 20 may be formed into a bassinet, generally shown as 108 in FIGS. 5 and 6, by laying the two sections 110, 112 of the bag down flat. In this position, the first piece of material 54, the second piece of material 56, and the intermediate piece of material 58 are all aligned in the same plane. Now, the outer surfaces 102, 102 of the flaps 92, 92 which have mating pieces of hook and loop fastener material 100, 100 attached to them are pressed against the mating pieces of hook and loop fastener material 72, 72 on the inner surfaces 74, 74 of the ends 68, 68 of the wall 62 of the first piece of material 54. (Alternatively in place of hook and loop fastener material, there can be used buttons, zippers or clasps.) Thus, as shown in FIG. 6, a bassinet 108 is formed for the baby.

When the two sections 110, 112 of the bag 20 are once again folded together to the closed position, the bag 20 may be fastened shut by bringing the means for fastening 76 attached to the upper edge of the wall 80 of the first piece of material 54 engagingly in union with the means for fastening 104 attached near the lower edge 88 of the wall 84 of the second piece of material 56. In the preferred embodiment this action is performed by pulling the zipper handle 26 and zipping the two sections together.

Thus each of these opposing sections 110, 112 have concave openings and can be so positioned that the concave openings of these concave shaped sections 110, 112 face each other as shown in FIG. 2 where, in fact, these two opposing sections of concave material are joined together by a zipper 25.

As shown in FIG. 7, the preferred embodiment of the baby supplies case consists of a case 38 having two interior shelves 40, 40 and a bottom shelf 41 which forms the bottom wall 48 of the unit 38. A container for holding baby wipes generally shown as 116 in FIG. 9, is rotatably attached to the bottom shelf 41 of the case 38 by a hinge 118 so that this container 116 may be rotated to a convenient position so that a baby wipe may be obtained with one hand while restraining the baby with the other hand.

As best seen in FIGS. 7, 8, and 9, the container for holding baby wipes 116 is hollow and is in the shape of a wedge having a broad or widened end 120 and a narrow hinge connection end 122 which is rotatably attached to the edge 124 of the horizontal bottom wall 48 by a hinge 118. The broad end 120 has two raised ridges 126, 126 at either end 128, 128 of the broad end 120. In the middle of this broad end 120 is an oval-shaped opening 130 providing access for the baby wipes contained therein. In order to keep the baby wipes moist, a protective lid 132 with chamfered edges 134, 134 is provided. During storage or stowage, the raised ridges 126, 126 retain the protective lid 132 flush against the oval-shaped opening 130, thus ensuring that the baby wipes remain moist. When this wedge shaped container 116 is rotated downward and the protective lid 132 is slid open, the oval-shaped opening 130 is revealed from which a baby wipe can be conveniently retrieved.

As best seen in FIGS. 7 and 8, the shelf 39 of the case 38 just above the horizontal bottom wall 48 has an elongated indentation 136 in its edge 138, suitably shaped to receive the broad end 120 of the wedge-shaped container 116 when the wedge-shaped container 116 is rotated to the vertical position. This indentation 136 in the shelf 40 prevents the wedge-shaped container 116 from being rotated backward past the vertical position. (If the container 116 were rotated all the way back, this would tend to weaken the hinge 118.) If the indentation were spaced a distance from either end of the shelf (nonpreferred and not shown), then the side edges 140, 140 of this indentation 136 would prevent the lid 132 from being slid in either direction after the wedge-shaped container 116 had been rotated to its vertical position. If, however, the indentation is cut all the way to an end of the shelf (preferred, and as shown in FIGS. 7, 8, and 9), then one side edge 140 of the indentation prevents the lid from being slid in the direction of the side edge 140, and the side wall 43 of the case 38 prevents the lid from being slid in the direction of the side wall 43 when the wedge-shaped container 116 is in the vertical position. Then when the wedge-shaped container 116 is rotated downward to a horizontal position, the lid 132 can easily be slid to either side permitting one to remove a baby wipe 114 with one hand while restraining the baby with the other hand.

Figure 8A:
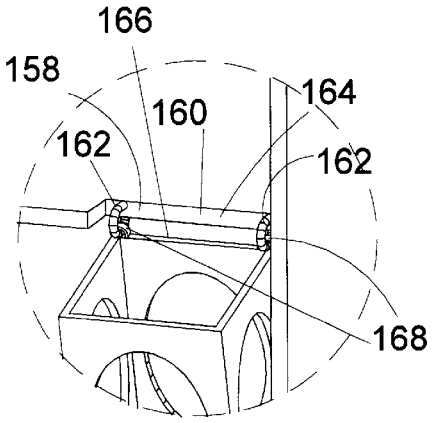
FIG. 8A shows an enlarged view of dashed circle 8A of FIG. 8.

As best seen in FIGS. 8 and 9, the holder for a container of baby powder or cream, generally shown as 142 in these figures, consists of a set of four connected vertical panels 144 and a bottom panel 148. Thus, the holder 142 is open at the top. At least the front and rear vertical panels 144, 144 have openings 150, 150 in them for one to insert one's fingers therein to squeeze the container 152 of baby powder or cream placed therein. The bottom panel 148 has an opening 154 therein of sufficient size to accommodate the cap 156 of the container 152. As shown in FIG. 8, the holder 142 for a container of baby powder or cream is attached to a middle shelf 39 of the case 38. During use it would be suspended from the shelf 39 as shown. For storage or stowage, it would be placed in its resting position as shown in FIG. 7. In its resting position, it rests inverted on the shelf 39 as shown in FIG. 7. As shown in FIGS. 8 and 8A, the edge 158 of the shelf 39 to which the holder 142 for a container of baby powder or ointment is attached has an elongated indentation 160 and two loop-like connectors 162, 162 fixedly attached at two locations on the edge 164 of the indentation 160. As best seen in FIG. 8A, the upper edge 166 of one of the vertical panels 144 of the holder 142 has two loop-like straps 168, 168 attached to it for receiving and being suspended from the two loop-like connectors 162, 162 attached to the edge of the indentation 164. Thus, the holder 142 hangs from the loop-like connectors 162, 162 by means of the straps 168, 168 attached to an upper edge of a panel 166 of the holder 142. While being so suspended, a container 152 of baby powder or cream may be inverted and inserted into the holder 142 with the cap 156 of the container 152 protruding through the opening 154 in the bottom panel 148 of the holder 142. FIG. 9 shows the holder with a container 152 so disposed therein. Now after rotating the holder 142 forward to a comfortable and convenient position, one would place one's hand under the holder 142, reach with one's fingers through the openings 150, 150 in the front and back vertical panels 144, 144 of the holder 142 and squeeze the container 152 thus causing the container 152 to release a portion of its contents into one's hand. Thus, baby powder may be dispensed into one hand while restraining the baby with the other hand. Alternatively, the upper edge 166 of the back panel 144 of the holder can be joined to the edge of the shelf indentation by means for joining such as duct tape or several spaced thin strips of plastic (not shown). Preferably this means for joining is sufficiently long so that in its storage position, the holder can rest nicely on the shelf to which it is attached.

Figure 10:
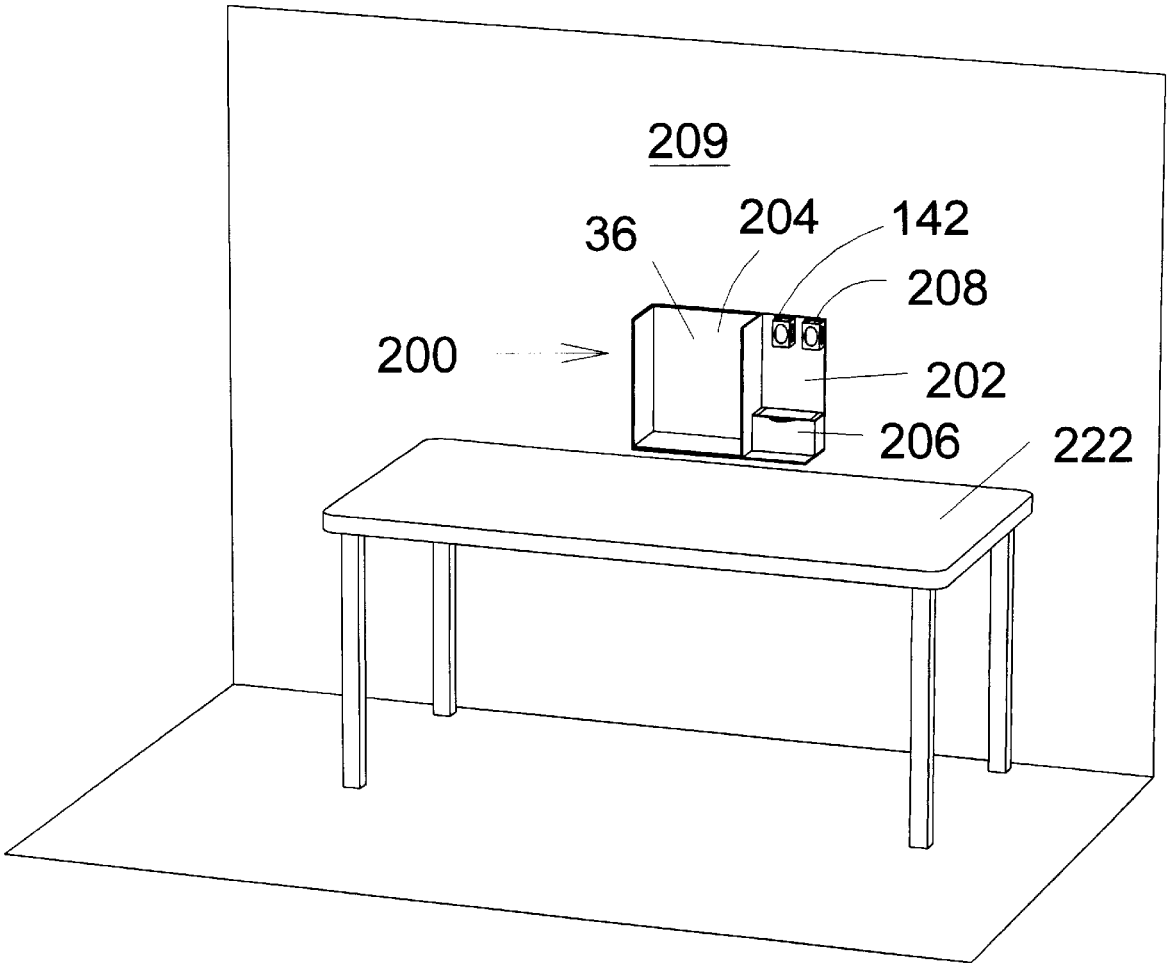
FIG. 10 shows a front perspective view of another embodiment of the instant invention mounted on the wall above a changing table.
Figure 11:
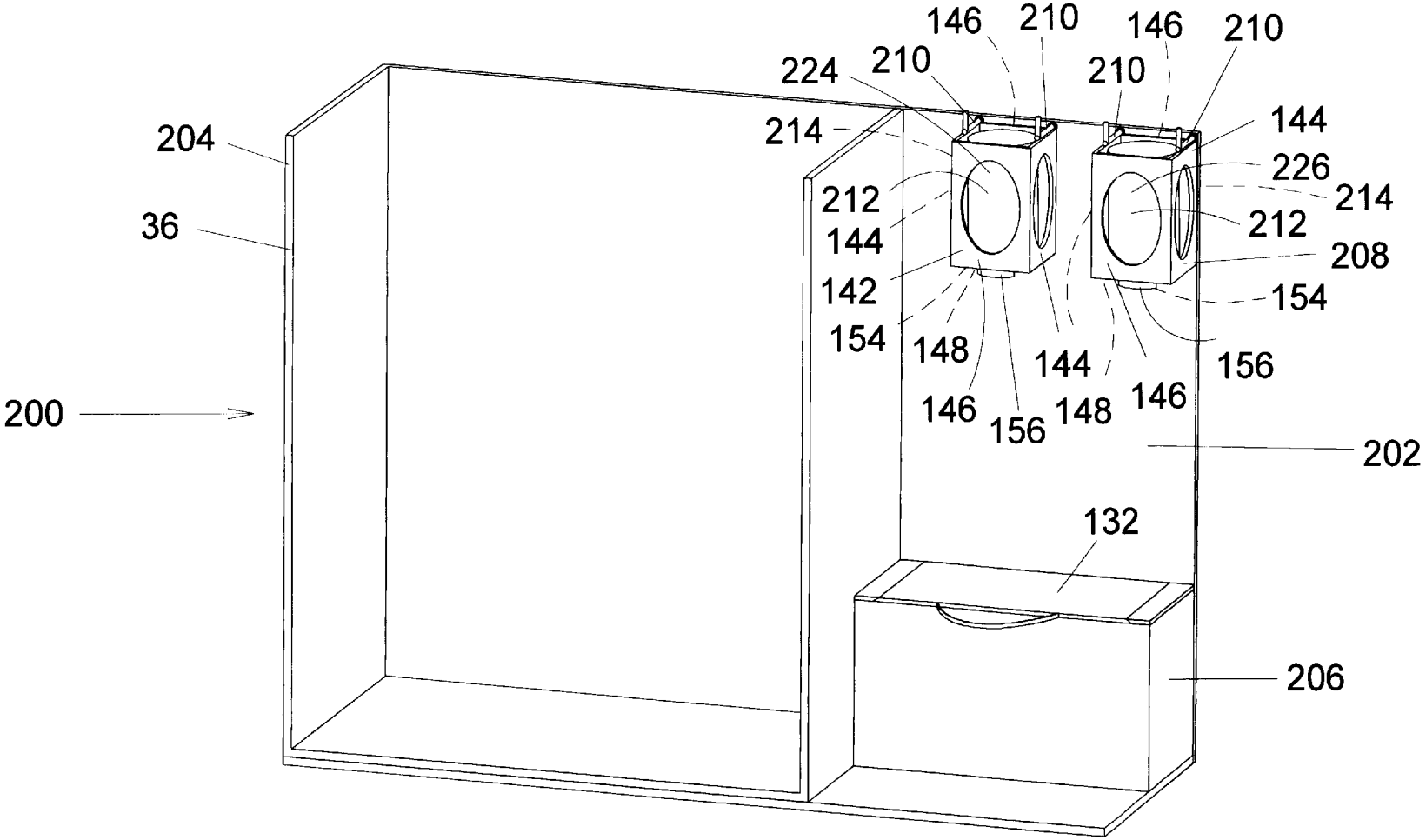
FIG. 11 shows an enlarged front perspective view of the embodiment of FIG. 10.
Figure 12:
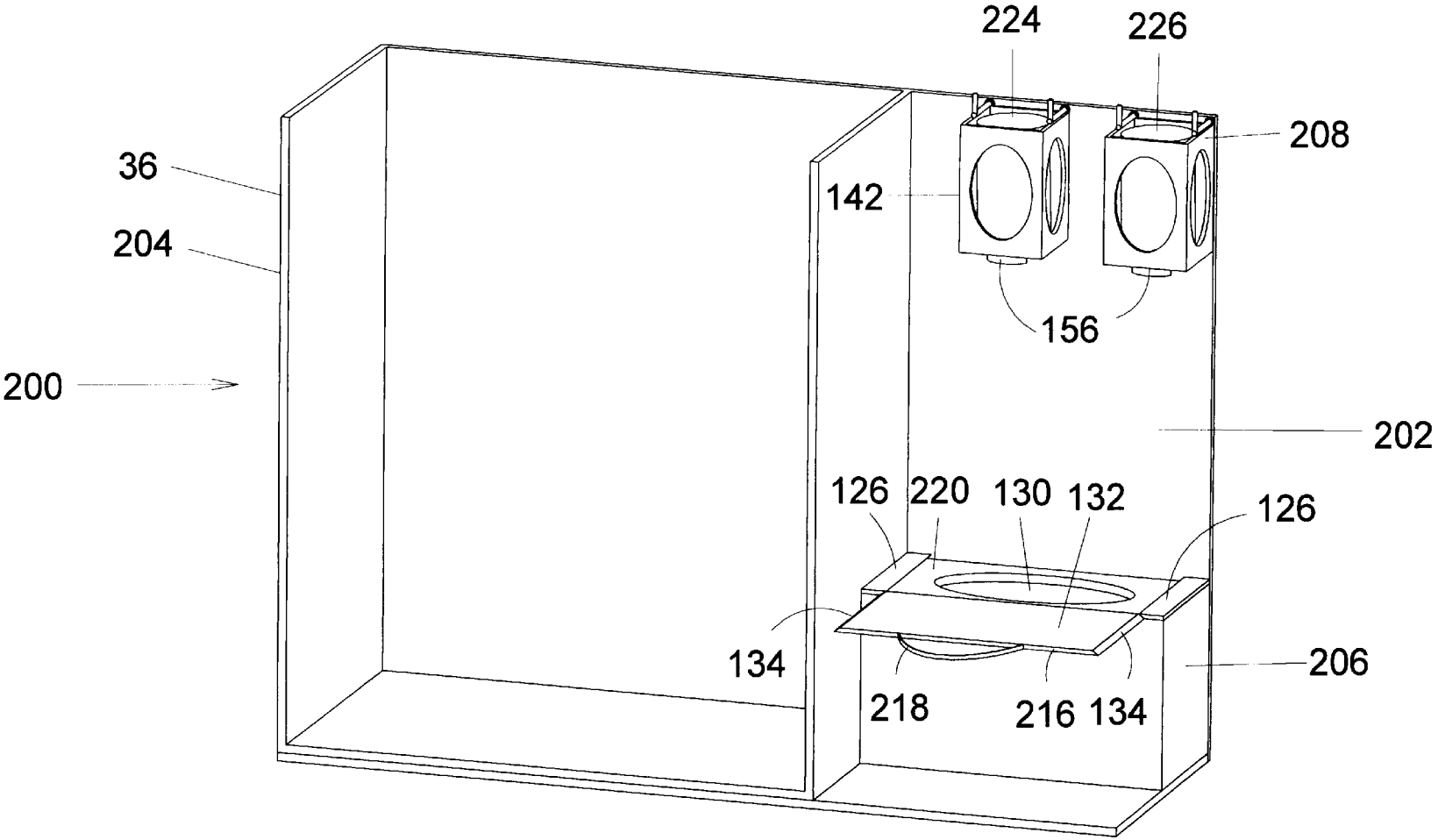
FIG. 12 shows an enlarged front perspective view of the embodiment of FIG. 10 with the sliding cover of the baby wipes container removed.

A lesser preferred embodiment of the instant invention is the wall unit model generally shown as 200 in FIGS. 10, 11, and 12. As shown by these figures, this embodiment consists of a rectangular board 202 to which is attached a compartment 36 such as compartment 204 for holding diapers, a container 206 for holding and dispensing baby wipes, a holder 142 for a container of baby powder, and a holder 208 for a container of baby cream. FIG. 10 shows this embodiment hanging on a wall 209 above changing table 222. As shown in these figures, the container 206 for holding baby wipes is connected on one side to the compartment 204 for holding diapers. For easy access to the diapers, the compartment 204 for holding diapers is open at the front and top. The holders for containers of baby powder and baby cream 142, 208 are movably connected to the rectangular board 202 which in turn is fixedly connected to the compartment 204 for holding diapers as mentioned above.

The holder 142 for a container of baby powder 224 consists of two side panels 144, 144, front and rear panels 146, 146, and a bottom panel 148. Thus, the holder 142 is open at the top. As shown best in FIGS. 11 and 12, the baby powder holder 142 hangs from two elongated support members 210, 210. At least the front and rear vertical panels 146, 146 have openings 212, 214 in them for one to insert one's fingers therein to squeeze a container 224 contained therein. For aesthetic reasons, it is preferred that the holes in each of the panels be identical in position, shape and size. The bottom panel 148 has an opening 154 therein of sufficient size to accommodate the cap 156 of the container of baby powder 224. Before using the instant invention, one would invert a container of baby powder 224 and place it in the holder 142 so that the cap 156 of the baby powder container 224 protrudes through the opening 154 in the bottom panel 148 of the holder 142. Then one would slide the baby powder holder 142 away from the rectangular board 202 along the elongated support members 210, 210 from which it hangs so that one can easily fit one's fingers behind the baby powder holder 142 in order to reach through the opening 214 in the rear panel 146. Baby powder can now be easily dispensed into one's hand by placing one's hand under the holder 142 while reaching with one's fingers through the openings 212, 214 in the front and rear vertical panels 146, 146 and squeezing the container 224 contained therein.

The holder 208 for a container of baby cream consists of two side panels 144, 144, front and rear panels 146, 146, and a bottom panel 148. Thus, the holder 208 is open at the top. As shown best in FIGS. 11 and 12, the baby cream holder 208 hangs from two elongated support members 210, 210. At least the front and rear vertical panels 146, 146 have openings 212, 214 in them for one to insert one's fingers therein to squeeze a container of baby cream 226 contained therein. For aesthetic reasons, it is preferred that the holes in each of the panels be identical in position, shape and size. The bottom panel 148 has an opening 154 therein of sufficient size to accommodate the cap 156 of a container of baby cream 226. Before using the instant invention, one would invert a container of baby cream 226 and place it in the holder 208 so that the cap 156 of the baby cream container 226 protrudes through the opening 154 in the bottom panel 148 of the holder 208. Then one would slide the baby cream holder 208 away from the rectangular board 202 along the elongated support members 210, 210 so that one can easily fit one's fingers behind the baby cream holder 208 in order to reach through the opening 214 in the rear panel 146. Baby cream can now be easily dispensed into one's hand by placing one's hand under the holder 208 while reaching with one's fingers through the openings 212, 214 in the front and rear vertical panels 146, 146 and squeezing the container 226 contained therein.

As best shown in FIG. 12, the container for holding baby wipes 206 consists of a hollow box with an oval opening 130 at the top which allows access to the baby wipes contained therein. In order that the baby wipes remain moist, the oval opening 130 is covered by a protective lid 132 with chamfered edges 134. The front edge 216 of the lid 132 has a strap handle 218 by which it may be pulled away from the oval opening 130. To access the baby wipes, one would pull the strap handle 218 toward oneself, which causes the lid 132 to slide away from the oval opening 130. Raised ridges 126, 126 at either end of the top 220 of the container 206, securely hold the lid 132 flush with the top 220 of the container 206 and smoothly guide the lid 132 away from the opening 130 as one pulls on the strap handle 218.

5.3 Advantages of the Invention

The previously described embodiments of the present invention have many advantages, including:

Diapers and other supplies can be very quickly organized on the readily accessible shelves of the baby supplies case. Once one opens the front flap of the baby bag, all supplies are readily visible and accessible.

The protective cover of the baby wipes container cannot be accidentally dislodged after the baby wipes container has been moved to its vertical storage position.

Due to the slant of the top of the baby wipes container when it is in its operational position, diapers on the shelf behind it will not snag on the container when they are pulled off the shelf.

Due to the attachment of the baby wipes container to the shelf, baby wipes can be pulled from the baby wipes container with one hand while restraining the baby with the other.

Due to the unique placement and design of the baby powder holder, baby powder may be dispensed into one hand while restraining the baby with the other hand.

The baby supplies case and baby/bag bassinet combination converts very quickly into a bassinet.

5.4 LIST OF REFERENCE NUMBERS

20 baby supplies case and bag/bassinet combination
22 strap
24 openable front flap
25 zipper
26 zipper handle
28 flexible strap
30 rear of baby bag
32 pouch
34 lip of pouch
36 compartment
38 baby supplies case
39 middle shelf of case
40 shelf of case
41 bottom shelf of case
42 vertical side wall of case
43 side wall of the case
44 back wall of case
46 horizontal top wall of baby supplies case
48 horizontal bottom wall of baby supplies case
50 drawer
52 flap
54 first rectangular piece of material
56 second rectangular piece of material
58 intermediate piece of joining material
60 edge of first rectangular piece of material
62 perpendicular side wall
64 fourth edge of first rectangular piece of material
66 lower edge of the perpendicular side wall
68 end of wall
70 fastening material
72 mating piece of hook and loop fastener material
74 inner surface of end of wall
76 means for fastening
78 mating zipper half-section
80 upper edge of wall
82 edge of second piece of material
84 perpendicular side wall
86 fourth edge of second piece of material
88 lower edge of wall 84
90 end of wall
92 flap
94 first end of flap
96 second end of flap
98 fastening material
100 mating piece of hook and loop fastener material
102 outer surface of flap

104 means for fastening
106 mating zipper half-section
108 bassinet
110 first section of bag
112 second section of bag
114 baby wipe
116 container for holding baby wipes
118 hinge
120 broad or widened end of container for holding baby wipes
122 narrow hinge connection end
124 edge of bottom horizontal wall
126 raised ridge
128 an end of broad end of baby wipes container
130 oval-shaped opening
132 protective lid
134 chamfered edge
136 elongated indentation
138 edge of shelf
140 side edge of indentation
142 holder for a container of baby powder
144 vertical panel
146 vertical panel with opening
148 bottom panel of holder
150 opening in vertical panel
152 container of baby powder or cream
154 opening in bottom panel of holder
156 cap of container
158 edge of shelf
160 elongated indentation
162 loop-like connector
164 edge of elongated indentation
166 upper edge of vertical panel
168 loop-like straps
200 wall unit model
202 rectangular board
204 compartment for holding diapers
206 container for holding and dispensing baby wipes
208 holder for a container of baby cream
209 wall
210 elongated support member
212 opening in front panel of holder
214 opening in rear panel of holder
216 front edge of lid
218 strap handle
220 top of container for holding baby wipes
222 changing table
224 container of baby powder
226 container of baby cream It will be understood that each of the elements described above, or two or more together may also find a useful application in other types of devices and methods differing from those types described above.

5.5 Alternatives and the Closing

Thus the reader will see that my baby supplies case and bag/bassinet combination supplies a long felt need for a simple, economical, easy to use baby bag and baby supplies case which can assist one immensely in changing a baby. If one should aver that my baby supplies case and bag/bassinet combination and the methods of using it are obvious, then one is hard put to explain why all those responsible for the care and comfort of infants have decided not to use such a device as an aid to quickly changing a baby. As it is, those responsible for babies have only very inconvenient traditional baby bags available for changing a baby, and really need three hands to change the baby efficiently. The instant invention, thus obviates the need for a third hand.

Although the present invention has been described in considerable detail with reference to certain preferred versions thereof, other versions are possible which will be apparent to those who are skilled in the art. While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Therefore, the spirit and scope of the appended claims should not be limited to the description of the preferred versions contained herein, but by the appended claims and their legal equivalents.

What is claimed is:

1. An apparatus for holding and dispensing baby supplies, said apparatus comprising:

(a) a compartment for holding diapers, said compartment having two side walls, a bottom wall and a back wall;

(b) a container having an interior for holding baby wipes connected to said compartment for holding diapers;

(c) at least one holder for a container of baby powder or ointment movably connected to said compartment for holding diapers, said holder comprising:

(i) a first set of two opposing vertical panels, each of said panels having an upper edge, a lower edge, and two side edges, said panels having openings therein;

(ii) a second set of two opposing vertical panels, each of said panels having an upper edge, a lower edge, and two side edges, said panels having openings therein, said second set of two opposing vertical panels being connected at their side edges to the side edges of the panels of the first set of two opposing vertical panels, so as to form the four vertical walls of a hollow rectangular container;

(iii) a bottom panel fixedly connected to the lower edges of the panels in each of the two sets of opposing vertical panels, said bottom panel having an opening therein;

said two sets of opposing vertical panels and said bottom panel forming the four walls and bottom of a hollow rectangular container.

2. The apparatus of claim 1, wherein the container for holding baby wipes comprises a hollow box having a lid slidably and removably attached to said hollow box.

3. The apparatus of claim 2, wherein said lid has a strap fixedly attached thereto for sliding said lid with respect to said hollow box for removing said lid front said hollow box so as to access the interior of said hollow box.

4. The apparatus of claim 1, further comprising a bag having a front side and a rear side, said front side having an openable flap for accessing the contents of said bag, said bag being sized to contain therein said compartment, said container, and said at least one holder.

5. The apparatus of claim 4, wherein said compartment is a case having two vertical walls and an upper horizontal wall and a bottom horizontal wall, each of said walls having an inner surface, an outer surface, and an edge, said case having at least one shelf, said case being sized to fit within said bag, said at least one shelf of said case being immediately visible and easily accessible when said openable flap is opened.

6. The apparatus of claim 5, further comprising a strap attached to the rear side of said bag and a pouch with a lip which is capable of being slid between said strap and said rear side of said bag for removably affixing said pouch to said bag.

7. The apparatus of claim 5, wherein said bag has an open position and a closed position, said bag comprising:

(a) a first section comprising (i) a first piece of material having a first edge and a second edge;

(ii) a wall perpendicularly connected to said first edge and running the length thereof, said wall having a lower edge by which it is fixedly attached to said first edge of said first piece of material and an upper edge, an inner surface, and an outer surface, and a first end and a second end, said first and second ends of said wall having fastening material affixed to the inner surfaces thereof, said wall having means for fastening attached to the upper edge thereof;

(b) a second section comprising (i) a second piece of material having a first edge and a second edge;

(ii) a wall perpendicularly connected to said first edge and running the length thereof, said wall having a lower edge by which it is fixedly attached to said first edge of said second piece of material and an upper edge, an inner surface and an cuter surface and a first end and a second end, said first and second ends of said wall having flaps hingedly attached thereto, each of said flaps having a first end hingedly attached to the end of the wall to which it is so attached, and a second end having fastening material affixed to the outer surface thereof, said wall having means for fastening attached proximate an edge thereof;

(c) an intermediate piece of material joining the first and second pieces of material at their second edges;

whereby when the bag is in its open position and said case is removed, and the first section, the second section, and the intermediate piece of material are all aligned in the same plane, and the outer surfaces of the flaps having fastening material attached thereto are pressed against the fastening material, on the inner surfaces of the ends of the wall of the first section, a bassinet is formed; and whereby when the bag is in its closed position, it may be fastened shut by bringing the means for fastening attached to the upper edge of the wall of the first section engagingly in union with the means for fastening attached to the edge of the wall of the second section.

8. The apparatus of claim 5, further comprising means for carrying the apparatus, said means for carrying being selected from the group consisting of straps, handles, and grips.

9. The apparatus of claim 5, wherein the container for holding baby wipes is hollow and is movably attached to a shelf of the case so that the container for holding baby wipes may be moved to a convenient position so that a baby wipe may be obtained with one hand while restraining a baby with the other hand.

10. The apparatus of claim 9, wherein the container for holding baby wipes is hollow and is in the shape of a wedge having a broad end having a length and a width, and a narrow hinge connection end, said broad end having an opening therein for obtaining a baby wipe therefrom, said broad end having a lid slidably attached thereto, the narrow hinge connection end of the container being rotatably attached to the edge of the bottom horizontal wall, the shelf of the case just above the bottom horizontal wall having an indentation in the edge of the shelf, said indentation having a length slightly longer than the length of said wedge, and a width slightly wider than the width of said wedge, thus said indentation snugly receives the broad end of the wedge-shaped container when the wedge-shaped container is rotated to a vertical position, said indentation in said shelf preventing said wedge-shaped container from being rotated past said vertical position, said indentation in the edge of the shelf preventing the lid from being slidably moved when the wedge-shaped container has been rotated to a vertical position, said lid being freely slidable when said wedge-shaped container is rotated to a horizontal position, thus permitting said lid to be slidably moved so that a baby wipe may be obtained with one hand while restraining a baby with the other hand.

11. The apparatus of claim 9, wherein the container for holding baby wipes is hollow and is in the shape of a wedge having a broad end having a length and a width, and a narrow hinge connection end, said broad end having an opening therein for obtaining a baby wipe therefrom, said broad end having a lid slidably attached thereto, the narrow hinge connection end of the container being rotatably attached to the edge of the bottom horizontal wall, the shelf of the case just above the bottom horizontal wall having an indentation in the edge of the shelf, said indentation having a length slightly longer than the length of said wedge, and a width slightly wider than the width of said wedge, thus said indentation snugly receives the broad end of the wedge-shaped container when the wedge-shaped container is rotated to a vertical position, said indentation in said shelf preventing said wedge-shaped container from being rotated past said vertical position, said indentation in the edge of the shelf preventing the lid from being slidably moved when the wedge-shaped container has been rotated to a vertical position, said wedge-shaped container when rotated to a horizontal position permitting said lid to be slidably moved so that a baby wipe may be obtained with one hand while restraining a baby with the other hand.

12. The apparatus of claim 5, wherein the at least one holder for a container of baby powder or ointment is attached to a shelf of the case.

13. The apparatus of claim 12, wherein the edge of the shelf to which the holder for a container of baby powder or ointment is attached has an indentation, and said apparatus further comprises means for joining said at least one holder to said shelf, said means for joining allowing said at least one holder to be moved with respect to said shelf, whereby said holder may be moved to a convenient position so that baby powder or ointment may be dispensed into one hand while restraining the baby with the other hand.

14. The apparatus of claim 13, wherein said means for joining is of a length to allow said at least one holder to occupy either a storage position or an operational position, in which said operational position baby powder or cream may be dispensed into one hand while restraining a baby with the other hand.

* * * * *